US010150206B2

(12) United States Patent
Ko

(10) Patent No.: US 10,150,206 B2
(45) Date of Patent: Dec. 11, 2018

(54) SCREWDRIVER TOOL

(71) Applicant: Ming-Hong Ko, Taichung (TW)

(72) Inventor: Ming-Hong Ko, Taichung (TW)

( * ) Notice: Subject to any disclaimer, the term of this patent is extended or adjusted under 35 U.S.C. 154(b) by 167 days.

(21) Appl. No.: 15/349,014

(22) Filed: Nov. 11, 2016

(65) Prior Publication Data

US 2018/0133870 A1 May 17, 2018

(51) Int. Cl.
*B25B 23/12* (2006.01)
*B25B 15/00* (2006.01)

(52) U.S. Cl.
CPC ..... *B25B 23/12* (2013.01); *B25B 15/002* (2013.01)

(58) Field of Classification Search
CPC ..... B25B 23/12; B25B 15/002
See application file for complete search history.

(56) References Cited

U.S. PATENT DOCUMENTS 9,833,887 B1 * 12/2017 Liu ..... B25B 23/12
2013/0220086 A1 * 8/2013 Peters ..... B23B 31/10 81/451
2013/0328276 A1 * 12/2013 Moss ..... B25B 23/0035 279/102
2014/0333037 A1 * 11/2014 Peters ..... B25B 23/12 279/50
2015/0336246 A1 * 11/2015 Peters ..... B23B 31/107 81/439
2016/0279769 A1 * 9/2016 Arslan ..... B25B 23/0064
2017/0036329 A1 * 2/2017 Santamarina ..... B25B 23/0035
2017/0120428 A1 * 5/2017 Wang ..... B25B 23/12
2017/0326713 A1 * 11/2017 Tsai ..... B25B 15/02

FOREIGN PATENT DOCUMENTS

TW I254660 B 5/2006

* cited by examiner

*Primary Examiner* — David B Thomas
(74) *Attorney, Agent, or Firm* — Alan D. Kamrath; Kamrath IP Lawfirm, P.A.

(57) ABSTRACT

A screwdriver tool contains: an operation rod and a magnetic attraction assembly. The operation rod includes a tool segment, a neck section, a first stop face, and a second stop face. The magnetic attraction assembly includes a slidable sleeve having an accommodation section, a magnetic attracting loop, an extension piece, and a covering piece. A diameter of the neck section is less than that of the tool segment, and an inner diameter of the accommodation section is more than an outer diameter of the tool segment. The extension piece and the covering piece of the slidable sleeve have at least one flange extending to the neck section and limited between the first stop face and the second stop face. Hence, the at least one flange of the extension piece and the covering piece slides on the neck section between the first stop face and the second stop face.

8 Claims, 14 Drawing Sheets

A-A

SCREWDRIVER TOOL

FIELD OF THE INVENTION

The present invention relates to a screwdriver tool which contains a slidable sleeve of a magnetic attraction assembly limited on and removed from a tool segment of an operation rod.

BACKGROUND OF THE INVENTION

A conventional screwdriver tool is employed to unlock a bolt. For example, a tool segment of the screwdriver tool is inserted into a trough of a head end of the bolt to unlock the bolt. However, the bolt removes from the tool segment of the screwdriver tool easily. To solve this problem, a magnetic attraction assembly is provided to magnetically attract the bolt.

With reference to FIG. 1, a conventional screwdriver tool 10 contains a tool segment 101, a peripheral slot 102 defined on an outer wall of the screwdriver tool 10, a slidable sleeve 11 fitted on the tool segment 101, a magnetic attracting loop 12 fixed on a front end of the slidable sleeve 11, and a C retainer 111 retained with the peripheral slot 102.

In operation, the slidable sleeve 11 is pushed forward so that the magnetic attracting loop 12 magnetically attracts a bolt 13. When the bolt 13 is pulled forward, the C retainer 111 retains with the peripheral slot 102 of the screwdriver tool 10 to avoid a removal of the slidable sleeve 11 and the magnetic attracting loop 12. Nevertheless, the C retainer 111 is not removed easily, and when the tool segment 101 of the screwdriver tool 10 is broken, the screwdriver tool 10, the salable sleeve 11, the magnetic attracting loop 12, and the C retainer 111 are discarded together.

Referring to FIGS. 2 and 3, a conventional screwdriver tool is disclosed in TW Publication No. I254660 and contains an operation rod 20 which has a head segment 201, a peripheral slot 202 defined on an outer wall of the operation rod 20, and a slidable sleeve 21 made of plastic material. The slidable sleeve 21 has a magnetic attraction sheath 22 fitted in a first end thereof, a fitting orifice 211 defined therein to fit with the operation rod 20, and a retaining shoulder 212 arranged in a second end thereof to retain with the head segment 201 of the operation rod 20.

When unlocking a screw 23, the slidable sleeve 21 is slid forward so that the magnetic attraction sheath 22 attracts the screw 23 magnetically. However, when desiring to pull the screw 23, the retaining shoulder 212 of the slidable sleeve 21 is pressed by the head segment 201 of the operation rod 20 to remove from the head segment 201, thus removing the slidable sleeve 21 from the operation rod 20 easily. In addition, when the head segment 201 of the operation rod 20 is broken, the slidable sleeve 21 and the magnetic attraction sheath 22 are thrown away with the operation rod 20.

The present invention has arisen to mitigate and/or obviate the afore-described disadvantages.

SUMMARY OF THE INVENTION

The primary objective of the present invention is to provide a screwdriver tool which magnetically attracts the bolt by way of the magnetic attraction assembly to avoid the bolt removing from the tool segment of the operation rod.

A further objective of the present invention is to provide a screwdriver tool which limits the slidable sleeve of the magnetic attraction assembly on the tool segment of the operation rod and avoids the magnetic attraction assembly removing from the operation rod.

Another objective of the present invention is to provide a screwdriver tool in which the covering piece is uncovered from the opening of the extension piece to release the slidable sleeve easily. The magnetic attraction assembly is removed from the operation rod to mate with another operation rod.

To achieve the above-mentioned objectives, a screwdriver tool provided by the present invention contains an operation rod and a magnetic attraction assembly.

The operation rod includes a tool segment, a neck section extending outwardly from a rear end of the tool segment, a first stop face defined on a front end of the neck section, and a second stop face formed on a rear end of the neck section.

The magnetic attraction assembly includes slidable sleeve, and the slidable sleeve has an accommodation section defined in the slidable sleeve, a magnetic attracting loop accommodated in a front end of the slidable sleeve, an extension piece extending outwardly from a rear end of the slidable sleeve and having an opening, and a covering piece covering the extension piece to close the opening of the extension piece.

A diameter of the neck section is less than that of the tool segment, and an inner diameter of the accommodation section is more than an outer diameter of the tool segment of the operation rod, so that the tool segment of the operation rod inserts into the accommodation section of the slidable sleeve.

The extension piece and the covering piece of the slidable sleeve have at least one flange extending to the neck section of the operation rod and limited between the first stop face and the second stop face of the neck section of the operation rod. Hence, the at least one flange of the extension piece and the covering piece slide on the neck section between the first stop face and the second stop face of the operation rod.

DETAILED DESCRIPTION OF THE PREFERRED EMBODIMENTS

Figure 1:
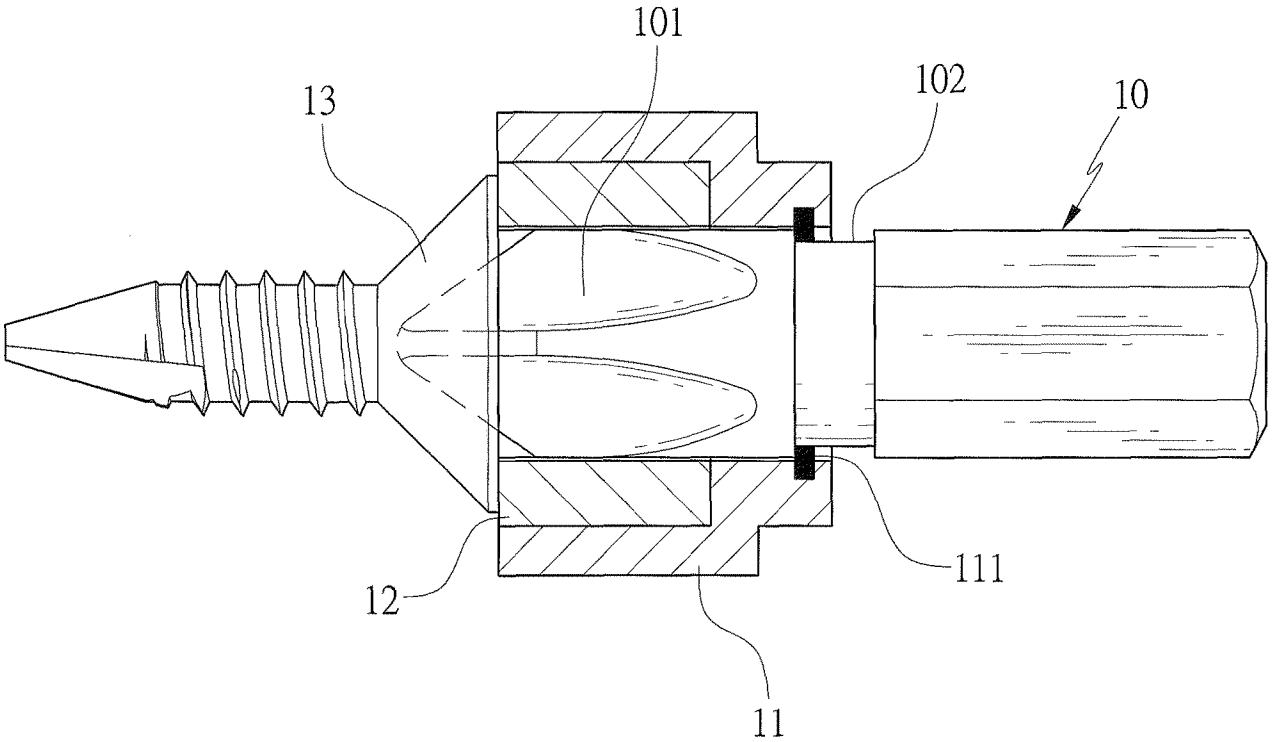
FIG. 1 PRIOR ART
FIG. 1 is a cross sectional view of a conventional screwdriver tool.
Figure 2:
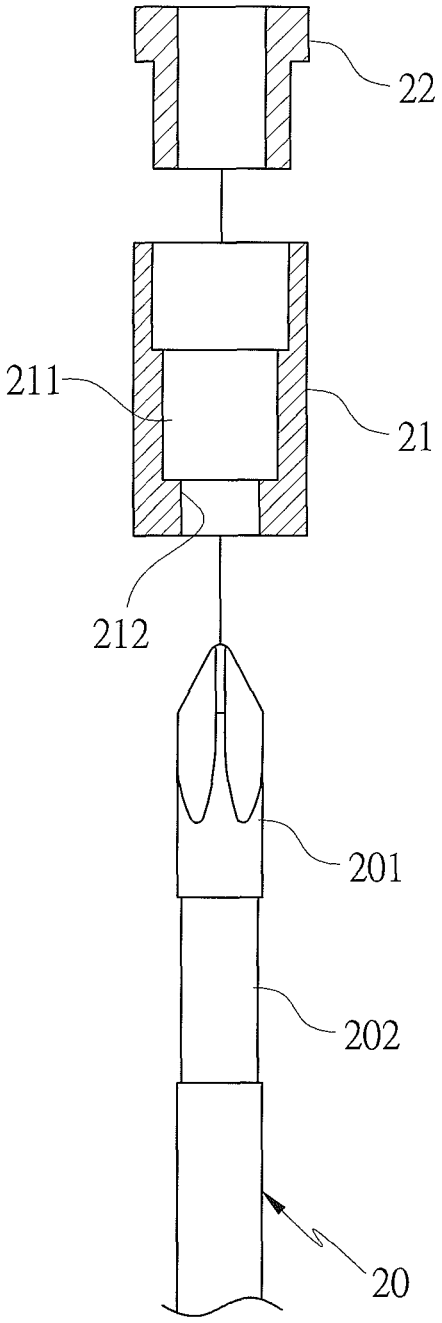
FIG. 2 PRIOR ART
FIG. 2 is a cross sectional view showing the exploded components of a conventional screwdriver tool disclosed in TW Publication No. I254660.
Figure 3:
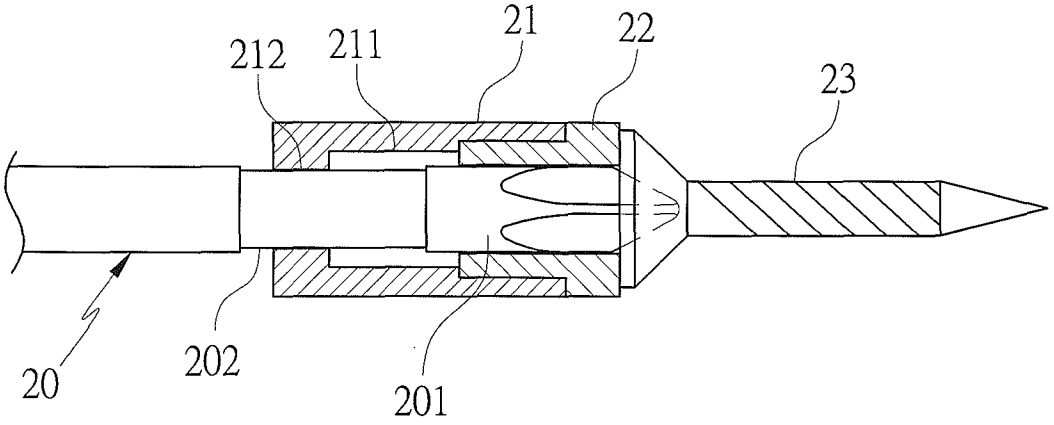
FIG. 3 PRIOR ART
FIG. 3 is a cross sectional view showing the assembly of the conventional screwdriver tool disclosed in TW Publication No. I254660.
Figure 4:
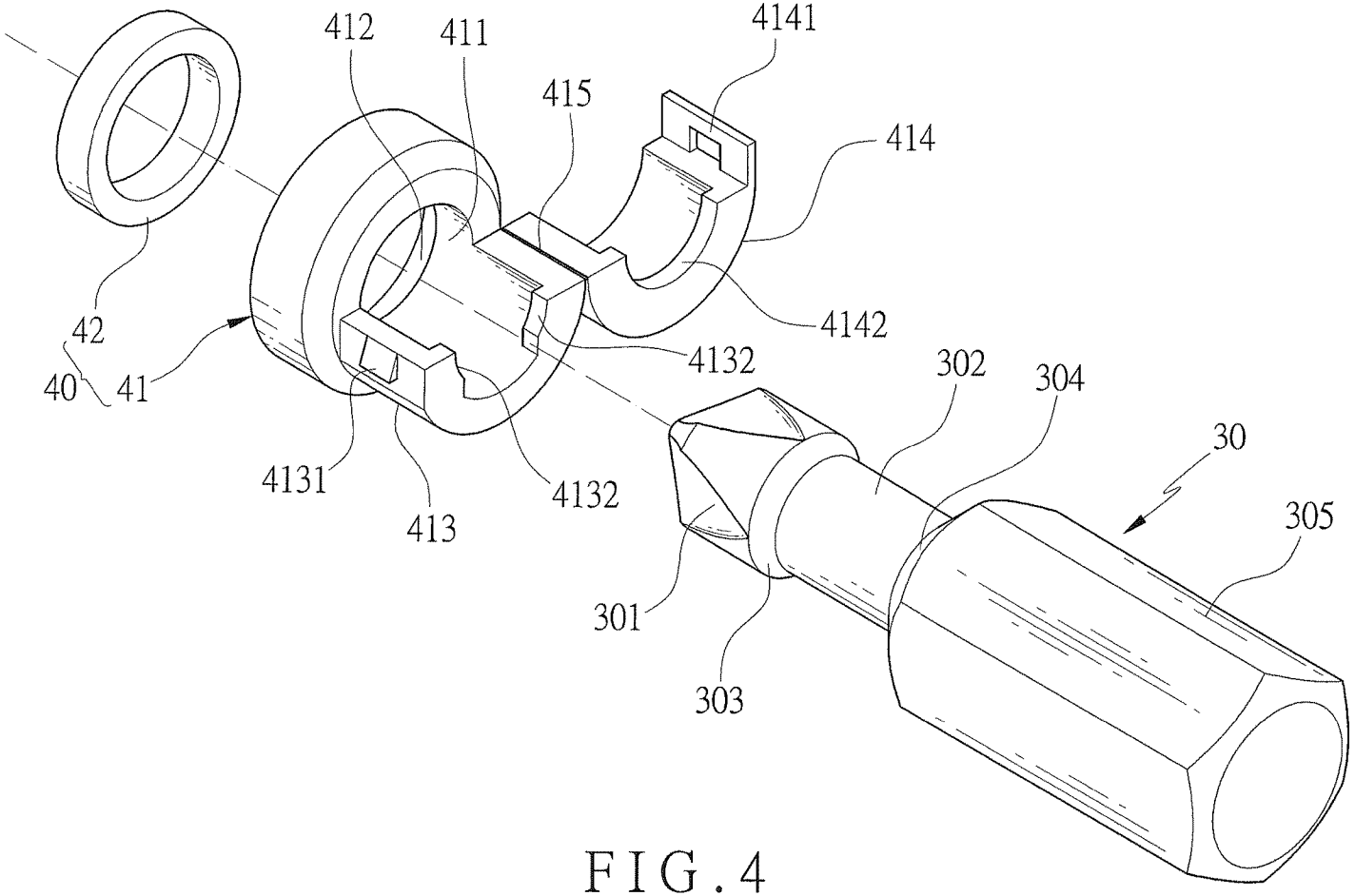
FIG. 4 is a perspective view showing the exploded components of a screwdriver tool according to a preferred embodiment of the present invention.
Figure 5:
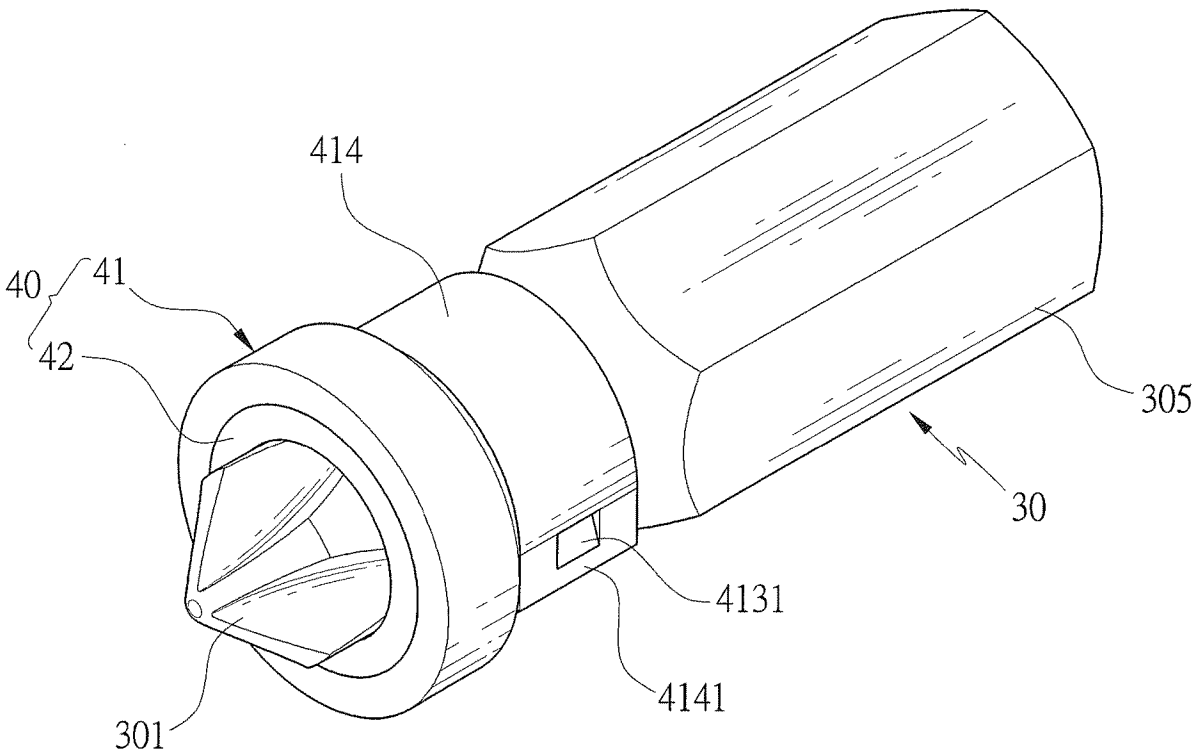
FIG. 5 is a perspective view showing the assembly of the screwdriver tool according to the preferred embodiment of the present invention.
Figure 6:
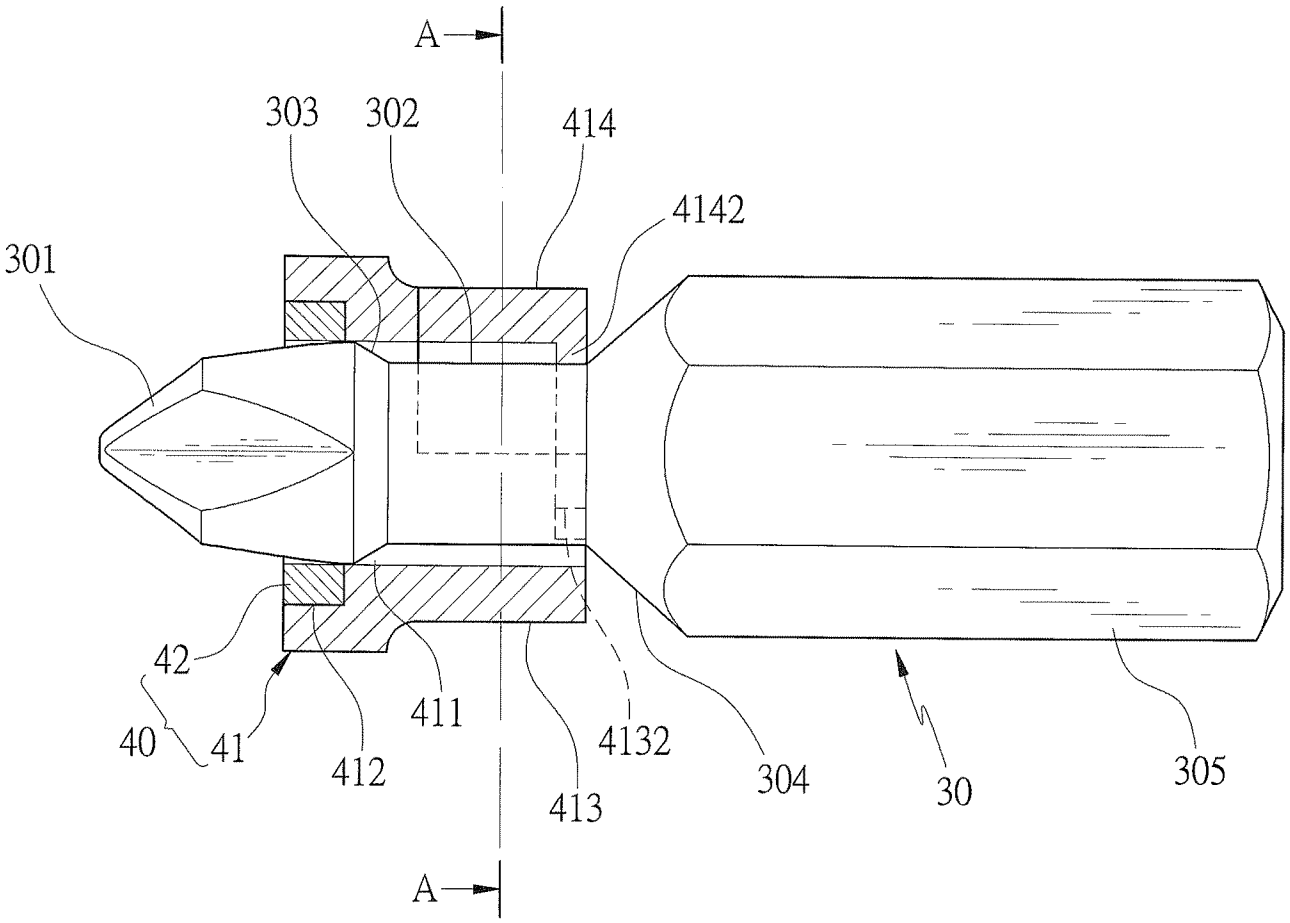
FIG. 6 is a cross sectional view showing the assembly of the screwdriver tool according to the preferred embodiment of the present invention.
Figure 7:
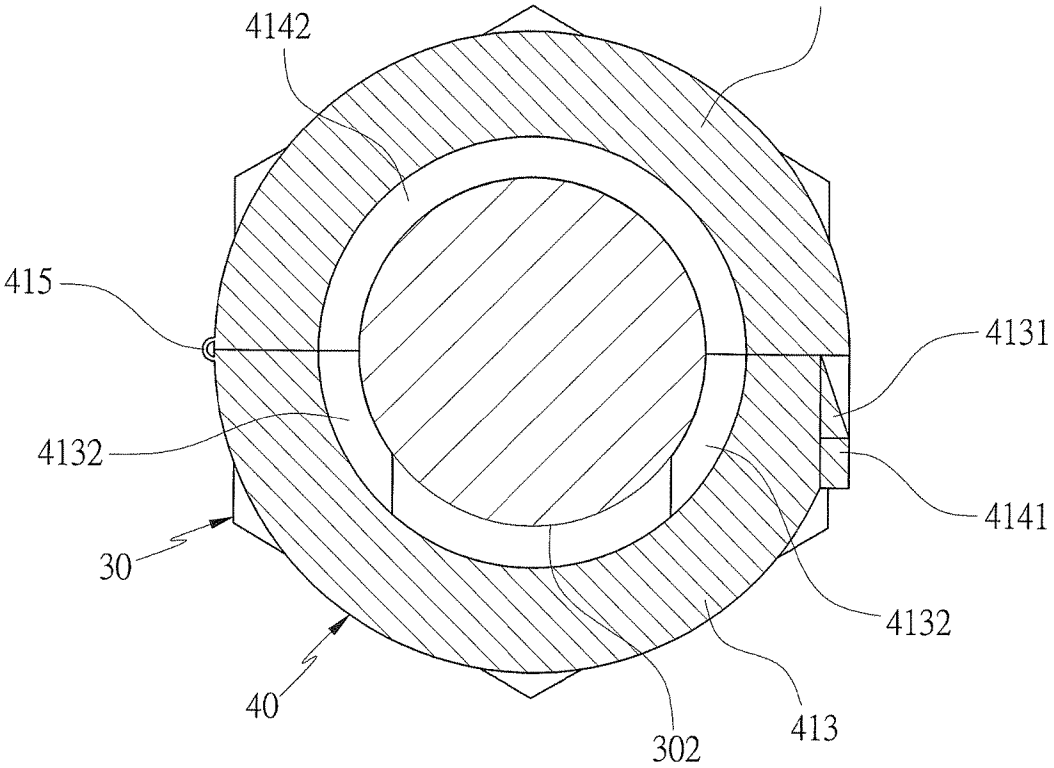
FIG. 7 is a cross sectional view taken along the line A-A of FIG. 6.

With reference to FIGS. 4-7, a screwdriver tool according to a preferred embodiment of the present invention comprises: an operation rod 30 and a magnetic attraction assembly 40. The operation rod 30 includes a tool segment 301 in various shapes (such as in a cross shape) and includes a neck section 302 extending outwardly from a rear end of the tool segment 301. A diameter of the neck section 302 is less than that of the tool segment 301. The operation rod 30 further includes a first stop face 303 defined on a front end of the neck section 302, a second stop face 304 formed on a rear end of the neck section 302, and a fitting section 305 extending outwardly from a rear end of the operation rod 30 and configured to fit with a driving tool. The fitting section 305 is in a hexagonal column shape. The magnetic attraction assembly 40 includes a slidable sleeve 41 made of plastic material. The slidable sleeve 41 has an accommodation section 411 defined therein, and an inner diameter of the accommodation section 411 is more than an outer diameter of the tool segment 301 of the operation rod 30. Thus, the tool segment 301 of the operation rod 30 inserts into the accommodation section 411 of the slidable sleeve 41, and the slidable sleeve 41 slides forward and backward on the tool segment 301 of the operation rod 30. The slidable sleeve 41 further has a housing groove 412 formed in a front end thereof to accommodate a magnetic attracting loop 42, an extension piece 413 extending outwardly from a rear end of the slidable sleeve 41 and having an opening, and a covering piece 414 covering the extension piece 413 to close the opening of the extension piece 413. In this embodiment, each of the extension piece 413 and the covering piece 414 is in a semicircular ring shape, and the slidable sleeve 41 further has a one-piece, flexible connection piece 415 formed on a first side edge of the extension piece 413 and a first side edge of the covering piece 414. Thus, the covering piece 414 covers the extension piece 413 by using the flexible connection piece 415 to close the opening of the extension piece 413. The extension piece 413 has a first retainer 4131 arranged on a second side edge thereof, and the covering piece 414 has a second retainer 4141 formed on a second side edge thereof and configured to retain with the first retainer 4131 of the extension piece 413. Hence, the covering piece 414 covers the extension piece 413 to close the opening of the extension piece 413. The extension piece 413 and the covering piece 414 of the slidable sleeve 41 have at least one flange extending to the neck section 302 of the operation rod 30 and limited between the first stop face 303 and the second stop face 304. Hence, the at least one flange of the extension piece 413 and the covering piece 414 slides on the neck section 302 between the first stop face 303 and the second stop face 304 of the operation rod 30. In this embodiment, the extension piece 413 has at least one first flange 4132 arranged on an inner wall thereof, and the covering piece 414 has a second flange 4142 arranged on an inner wall thereof and corresponding to the at least one first flange 4132. An inner diameter defined by the at least one first flange 4132 and the second flange 4142 is less than the outer diameter of the tool segment 301 of the operation rod 30, and the at least one first flange 4132 and the second flange 4142 extend to the neck section 302 of the operation rod 30 and are limited between the first stop face 303 and the second stop face 304. Hence, the at least one first flange 4132 and the second flange 4142 slide on the neck section 302 between the first stop face 303 and the second stop face 304 of the operation rod 30, and the magnetic attraction assembly 40 moves forward and backward on the tool segment 301 of the operation rod 30.

Figure 8:
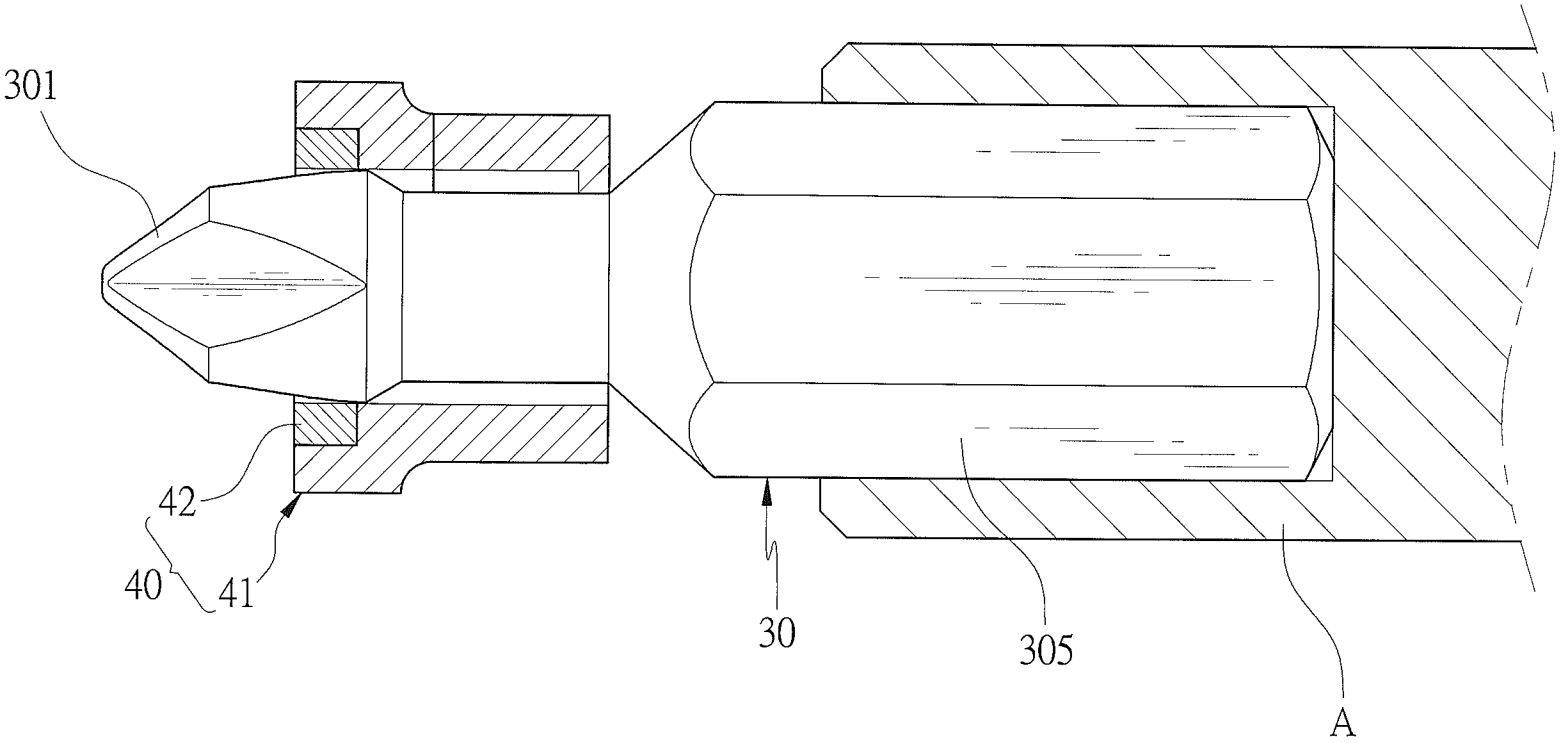
FIGS. 8 to 12 are cross sectional views showing the operation of the screwdriver tool according to the preferred embodiment of the present invention.
Figure 9:
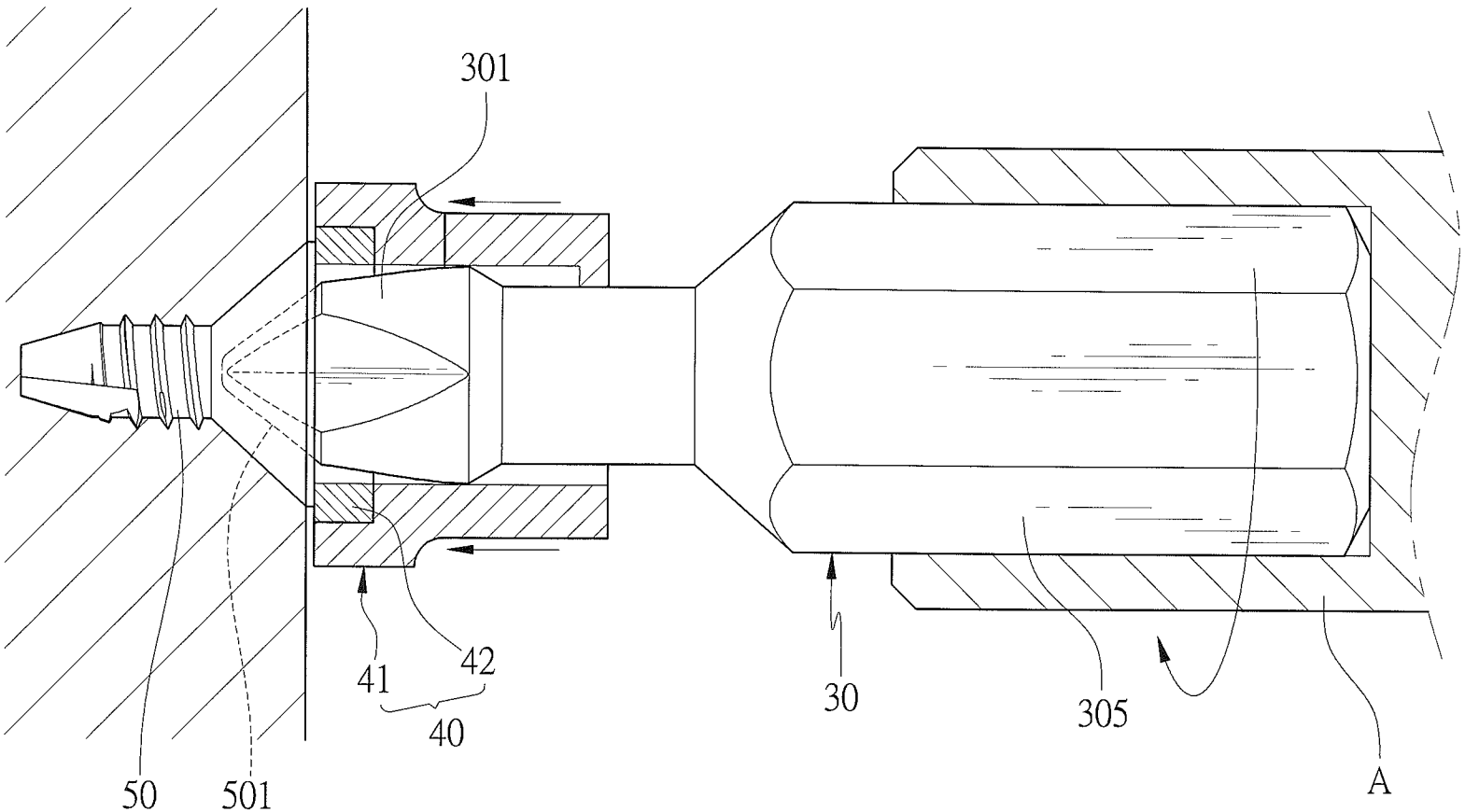
Figure 10:
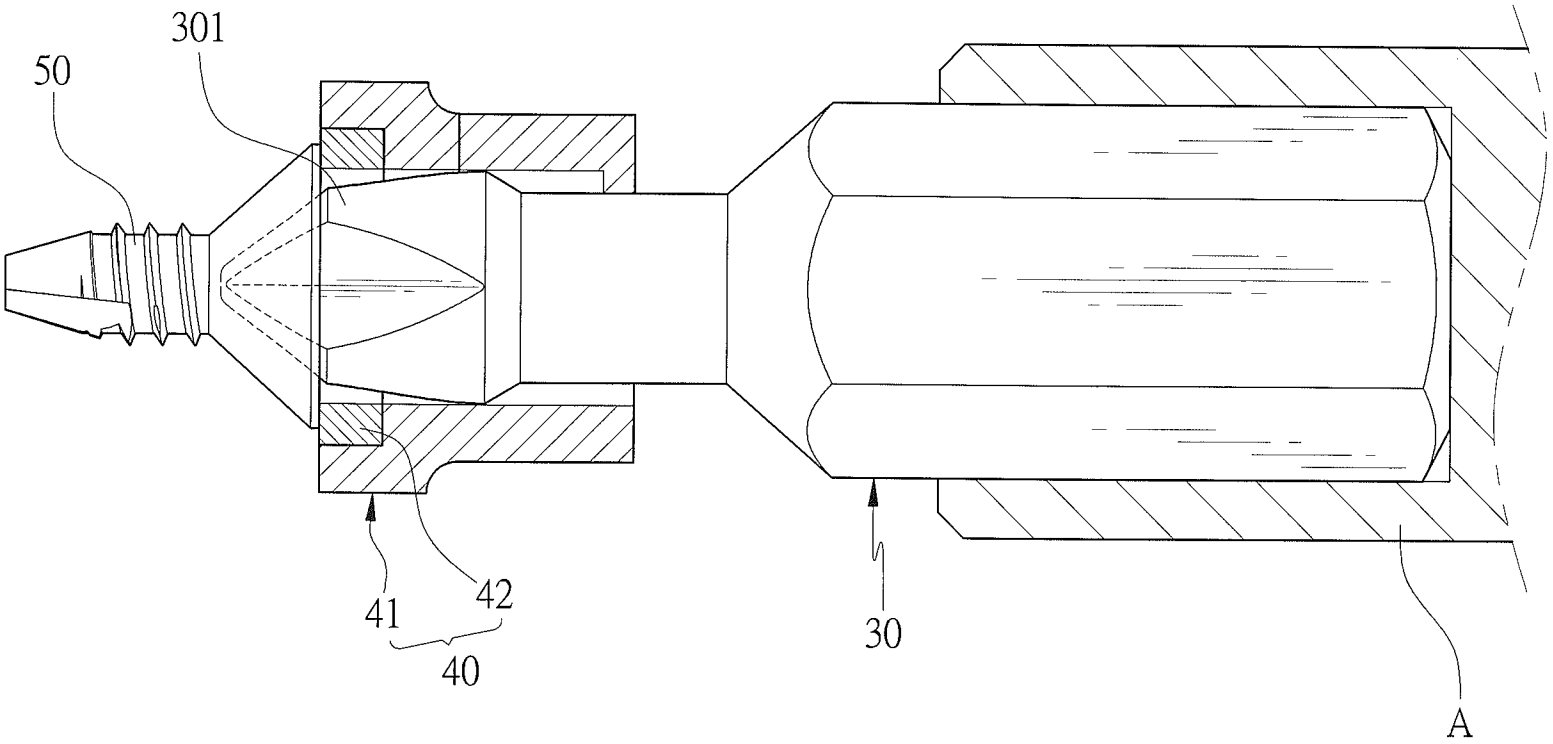

Referring to FIG. 8, in operation, the fitting section 305 of the operation rod 30 is fitted with the driving tool A to lock and unlock a bolt. For example, as shown in FIG. 9, the tool segment 301 of the operation rod 30 is inserted into a cross-shaped trough 501 of a head end of the bolt 50, the slidable sleeve 41 of the magnetic attraction assembly 40 is pushed forward so that the magnetic attracting loop 42 of the slidable sleeve 41 magnetically attracts the head end of the bolt 50, and the driving tool A drives the operation rod 30 to rotate. Hence, the tool segment 301 of the operation rod 30 rotatably unlocks the bolt 50. After unlocking the bolt 50, as illustrated in FIG. 10, the magnetic attracting loop 42 of the magnetic attraction assembly 40 attracts the bolt 50 securely.

Figure 11:
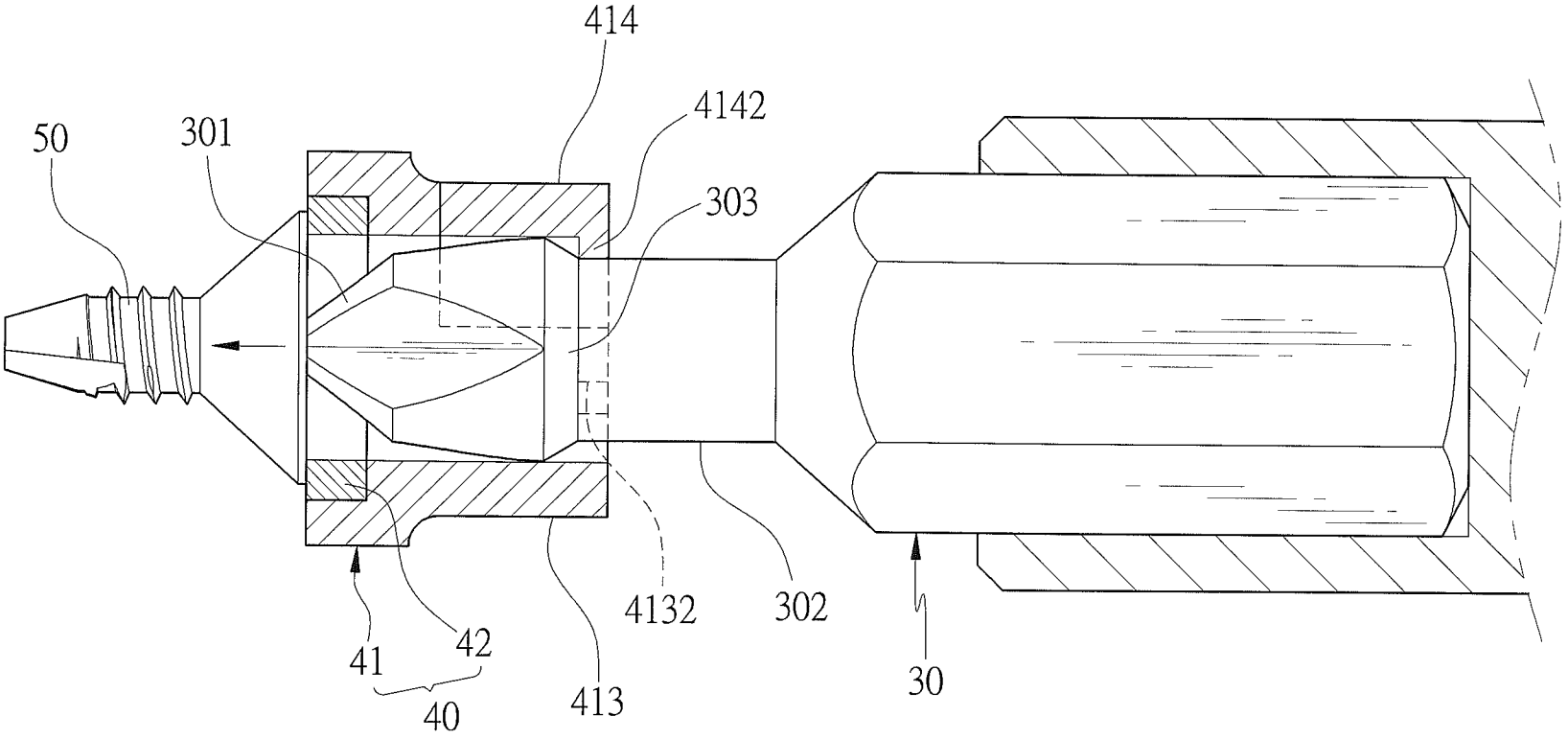
Figure 12:
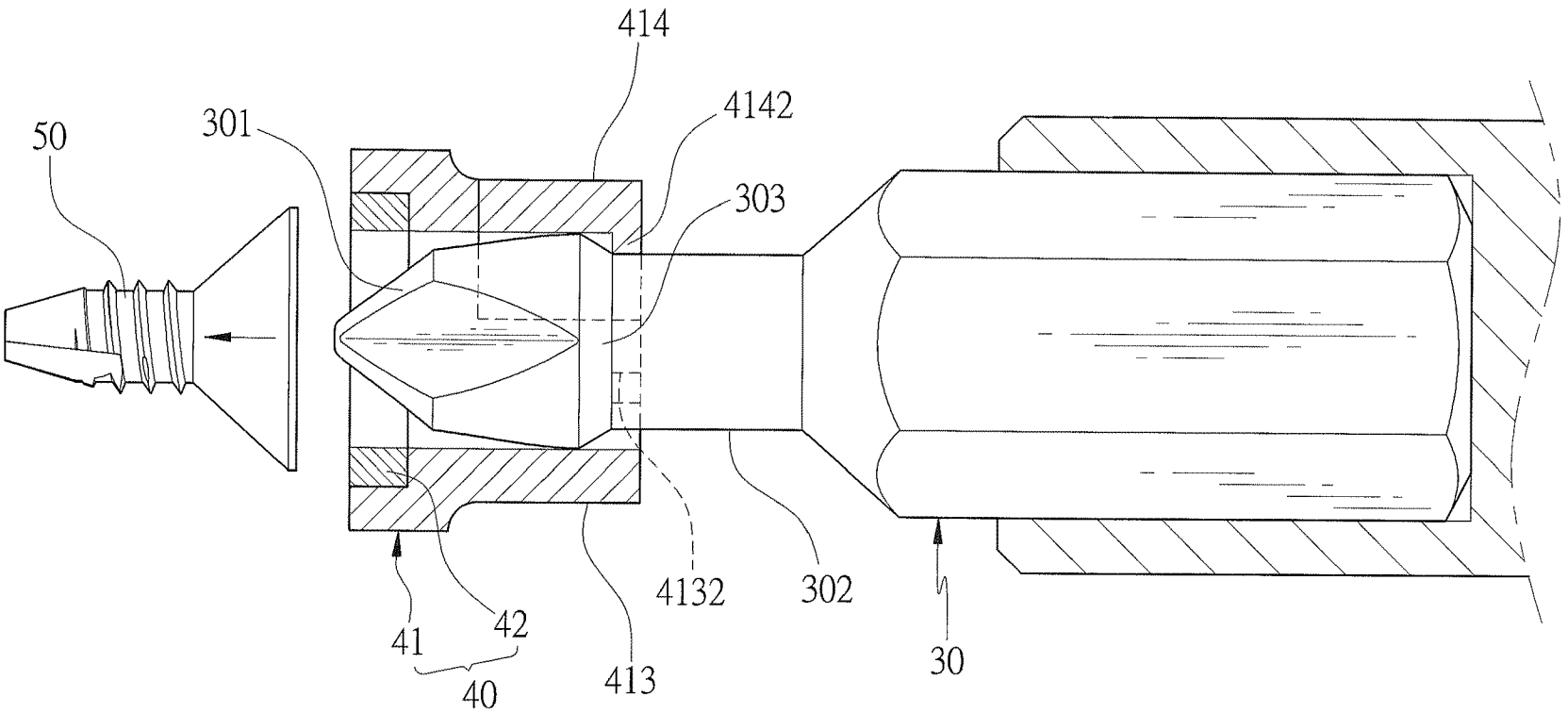

Referring to FIGS. 11 and 12, the bolt 50 is pulled forward so that the slidable sleeve 41 of the magnetic attraction assembly 40 moves forward with the bolt 50 by way of the magnetic attracting loop 42, and the first stop face 303 of the operation rod 30 stops the at least one first flange 4132 of the extension piece 413 and the second flange 4142 of the covering piece 414. When removing the bolt 50, the slidable sleeve 41 of the magnetic attraction assembly 40 is limited on the tool segment 301 of the operation rod 30, and the magnetic attraction assembly 40 does not remove from the operation rod 30.

Figure 13:
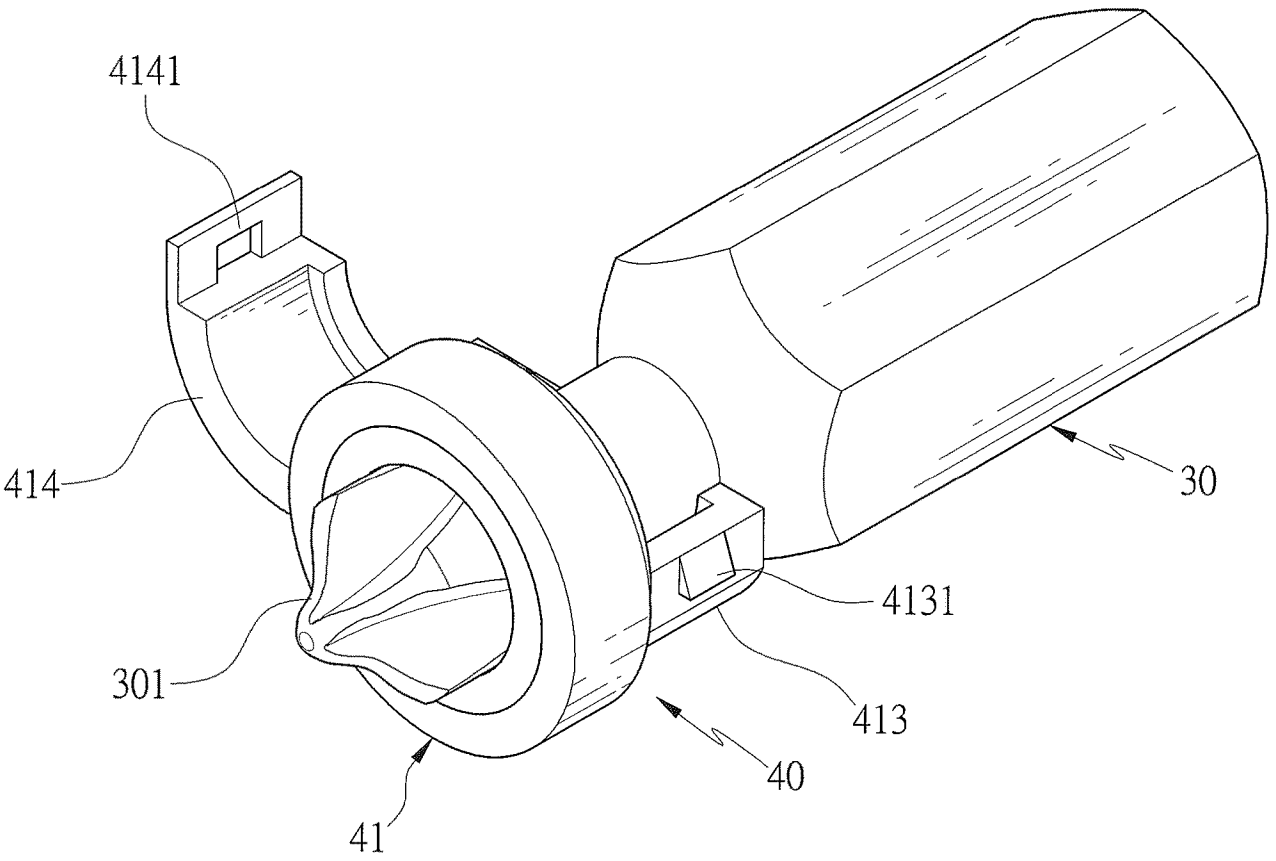
FIG. 13 is a perspective view showing the operation of the screwdriver tool according to the preferred embodiment of the present invention.
Figure 14:
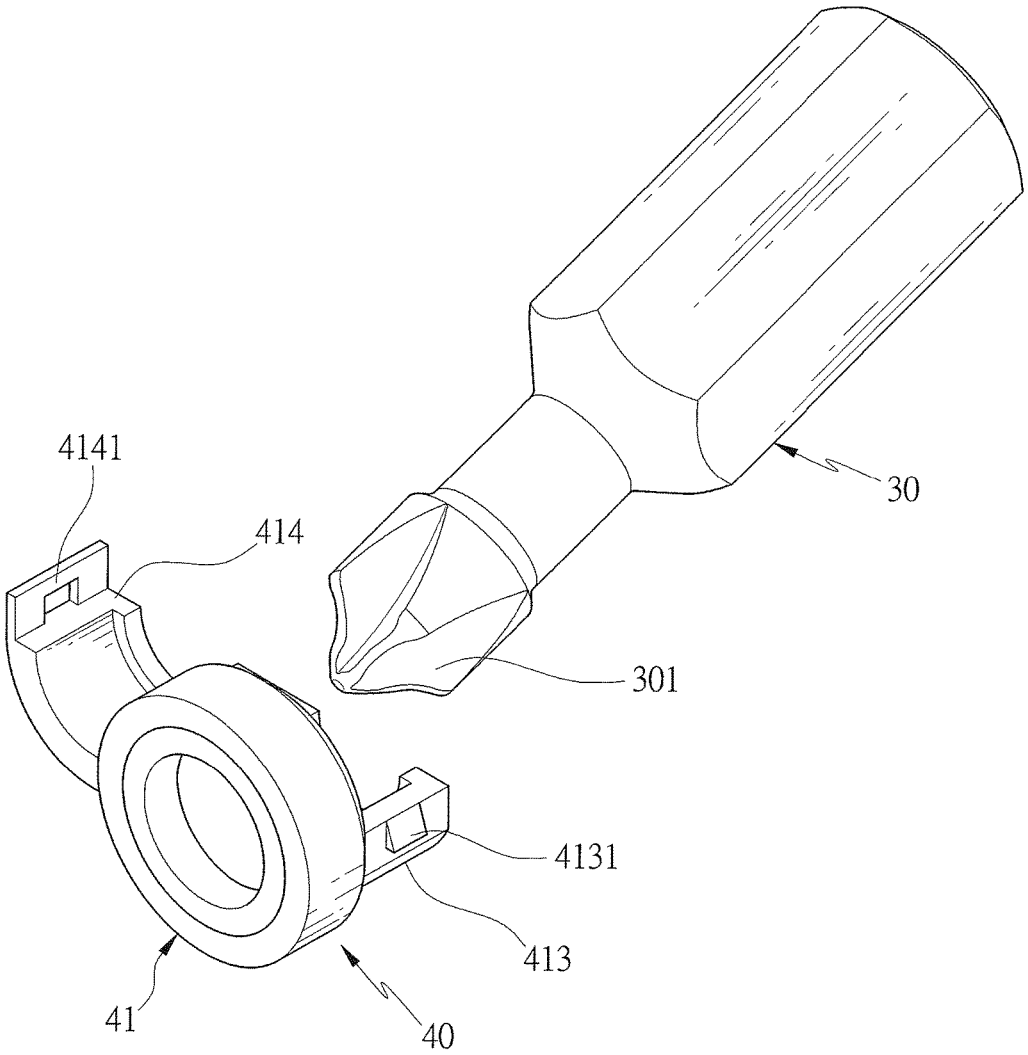
FIG. 14 is another perspective view showing the operation of the screwdriver tool according to the preferred embodiment of the present invention.

With reference to FIGS. 13 and 14, when the tool segment 301 of the operation rod 30 is broken, the second retainer 4141 of the covering piece 414 is removed from the first retainer 4131 of the extension piece 413, and the covering piece 414 is uncovered from the extension piece 413 to open the opening of the extension piece 413. Hence, the slidable sleeve 41 is released and the magnetic attraction assembly 40 is removed from the operation rod 30 to mate with another operation rod 30.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A screwdriver tool comprising:

an operation rod including a tool segment, a neck section extending outwardly from a rear end of the tool segment, a first stop face defined on a front end of the neck section, and a second stop face formed on a rear end of the neck section; and a magnetic attraction assembly including a slidable sleeve, wherein the slidable sleeve has an accommodation section defined in the slidable sleeve, a magnetic attracting loop accommodated in a front end of the slidable sleeve, an extension piece extending outwardly from a rear end of the slidable sleeve and having an opening, a covering piece covering the extension piece to close the opening of the extension piece, and a one-piece flexible connection piece formed on a first side edge of the extension piece and a first side edge of the covering piece;

wherein a diameter of the neck section is less than that of the tool segment;

wherein an inner diameter of the accommodation section is more than an outer diameter of the tool segment of the operation rod so that the tool segment of the operation rod inserts into the accommodation section of the slidable sleeve;

wherein the extension piece and the covering piece of the slidable sleeve have at least one flange extending to the neck section of the operation rod and limited between the first stop face and the second stop face of the neck section of the operation rod; and wherein the at least one flange of the extension piece and the covering piece slide on the neck section between the first stop face and the second stop face of the operation rod.

2. The screwdriver tool as claimed in claim 1, wherein the operation rod further includes a fitting section extending outwardly from a rear end thereof, and wherein the fitting section is in a hexagonal column shape.

3. The screwdriver tool as claimed in claim 1, wherein the slidable sleeve of the magnetic attraction assembly is made of plastic material.

4. The screwdriver tool as claimed in claim 1, wherein the slidable sleeve of the magnetic attraction assembly further has a housing groove formed in the front end thereof to accommodate the magnetic attracting loop.

5. The screwdriver tool as claimed in claim 1, wherein each of the extension piece and the covering piece is in a semicircular ring shape.

6. The screwdriver tool as claimed in claim 1, wherein the extension piece has a first retainer arranged on a second side edge thereof, and wherein the covering piece has a second retainer formed on a second side edge thereof and configured to retain with the first retainer of the extension piece.

7. The screwdriver tool as claimed in claim 1, wherein the extension piece has at least one first flange arranged on an inner wall thereof, and wherein the covering piece has a second flange arranged on an inner wall thereof and corresponding to the at least one first flange.

8. The screwdriver tool as claimed in claim 7, wherein an inner diameter defined by the at least one first flange of the extension piece and the second flange of the covering piece is less than the outer diameter of the tool segment of the operation rod, and wherein the at least one first flange and the second flange extend to the neck section of the operation rod.

* * * * *